United States Patent [19]

Carver et al.

[11] 4,196,423

[45] Apr. 1, 1980

[54] ACOUSTIC EMISSION INTRUSION DETECTOR

[75] Inventors: Donald W. Carver; Jerry W. Whittaker, both of Knoxville, Tenn.

[73] Assignee: The United States of America as represented by the United States Department of Energy, Washington, D.C.

[21] Appl. No.: 932,150

[22] Filed: Aug. 9, 1978

[51] Int. Cl.[2] ..... G08B 13/22

[52] U.S. Cl. ..... 340/566; 307/117; 324/78 R; 340/550

[58] Field of Search ..... 340/566, 550; 307/117; 324/78 R

[56] References Cited

U.S. PATENT DOCUMENTS

| | | | |
|---|---|---|---|
| 3,717,864 | 2/1973 | Cook et al. | 340/566 |
| 3,733,598 | 5/1973 | Kato | 340/566 |
| 3,805,260 | 4/1974 | Barowitz | 307/117 |
| 3,922,663 | 11/1975 | Lubke et al. | 340/566 |
| 4,096,474 | 6/1978 | Greer et al. | 340/566 |
| 4,099,168 | 7/1978 | Kedjierski et al. | 340/566 |
| 4,134,109 | 1/1979 | McCormick et al. | 340/566 |

OTHER PUBLICATIONS

Wells Fargo Alarm Services, "Cu-2 Vibration Detection System", Washington, D.C.

*Primary Examiner*—Glen R. Swann, III
*Attorney, Agent, or Firm*—R. V. Lupo; Robert M. Poteat; Stephen D. Hamel

[57] ABSTRACT

An intrusion detector is provided for detecting a forcible entry into a secured structure while minimizing false alarms. The detector uses a piezoelectric crystal transducer to sense acoustic emissions. The transducer output is amplified by a selectable gain amplifier to control the sensitivity. The rectified output of the amplifier is applied to a Schmitt trigger circuit having a preselected threshold level to provide amplitude discrimination. Timing circuitry is provided which is activated by successive pulses from the Schmitt trigger which lie within a selected time frame for frequency discrimination. Detected signals having proper amplitude and frequency trigger an alarm within the first complete cycle time of a detected acoustical disturbance signal.

4 Claims, 3 Drawing Figures

ACOUSTIC EMISSION INTRUSION DETECTOR

BACKGROUND OF THE INVENTION

This invention was made during the course of, or under, a contract with the U.S. Department of Energy.

This invention relates generally to security alarm systems which operate by detection of acoustic emissions generated during forcible entry through walls, ceilings or floors of security vaults, or other detected structures and more specifically to an acoustic emission intrusion detector for detecting a forcible entry into a secured structure while minimizing false alarms which would normally be generated by extraneous acoustical signals from nearby vehicular traffic, normal entry into the secured structure, thunder, etc.

In the art, crystal-type acoustic emission transducers have been employed with various electronic circuits for processing and amplifying the signal produced by the crystal to sound an alarm when persistent acoustical emissions are detected, such as hammer blows on the walls of a secured structure or other acoustical emissions generated by various forcible entry means. Generally, these systems include various means for scrutinizing acoustical emissions detected by the transducer to eliminate false or nuisance alarms, such as those generated by sounds which are not related to forcible entry into a secured structure being monitored by the system. In one particular system, which may be considered most closely related to the present invention, nuisance alarms are inhibited by requiring two or more acoustical disturbances to occur over a fixed period of time. Such a system is a Model CU-2 Vibration Detection System marketed by the Wells Fargo Alarm Services, Washington, D. C.

An acoustic emission intrusion detecting system is needed in the security system for detecting a forcible entry into facilities used for storing special nuclear materials. The requirements are that the alarm must be highly sensitive and provide an extremely fast response for proper surveillance through a supervised alarm system for such a special storage facility.

SUMMARY OF THE INVENTION

In view of the above need, it is a primary object of this invention to provide a sensitive and highly responsive alarm system for detecting a forcible entry into a secured structure, while generating only a negligible number of nuisance alarms.

According to the invention, an acoustic emission intrusion detection system is provided whch uses a sensitive, crystal-type transducer that may be attached to a smooth surface on the interior walls of a room or vault being monitored. A typical signal output from the transducer, due to a hammer blow on concrete or tile walls, is a damped sinusoid of approximately five milliseconds duration at a frequency of 1100 to 1300 Hz. The initial amplitude of the signal varies with the type of construction and distance from the disturbance to the detector, but it is typically 5 to 10 millivolts. When the transducer is attached to the steel in a reinforced wall the output signal due to a hammer blow or metal saw stroke is a similar output of approximately 15 milliseconds duration at about 3500 Hz.

A small, low-powered prcoessor is provided to convert the transducer output to an alarm signal which may be used to activate an alarm or operate remote indicators in a supervised alarm loop. The processor consists of a preamplifier stage with a field-effect transistor input followed by an adjustable gain second amplifier stage, whereby the overall gain selection of the processor may be chosen for the particular application. In addition, the second amplifier stage rectifies the amplified transducer signal before routing the signal to a digital portion of the circuit. Filter circuits are provided in the amplifier stages for low-frequency cutoff which may be fixed at about 800 Hz, thereby eliminating unwanted signals below this frequency. The amplifier is followed by a Schmitt trigger circuit whose threshold level is selected for proper amplitude discrimination of the rectified transducer signal. Timing circuitry is provided which is activated by pulses from the Schmitt trigger circuit and is designed to provide proper frequency discrimination so that when an acoustical signal has sufficient amplitude and is of the proper frequency, the signal is routed to a pulse-shaping circuit, followed by an alarm driver. The system is designed such that signals of the proper amplitude and frequency will provide an alarm conditon within the first complete cycle time of the acoustical disturbance signal, thereby providing a highly responsive alarm system.

Other objects and many of the attendant advantages of the present invention will be obvious to those skilled in the art from the following detailed description taken in conjunction with the drawings.

DETAILED DESCRIPTION

Figure 1:
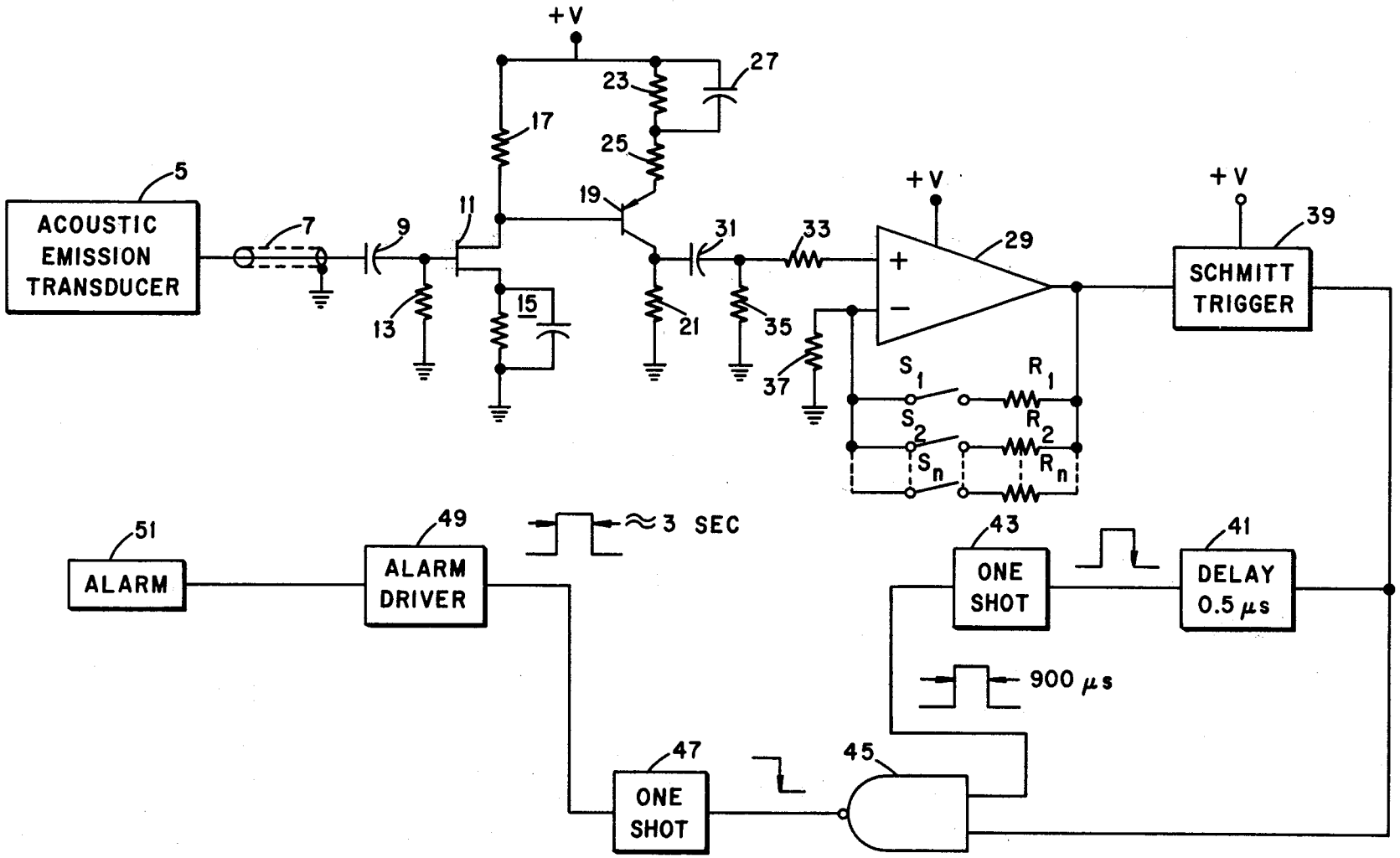
FIG. 1 is a schematic diagram of an acoustic emission intrusion detector according to the present invention.

Refering now to FIG. 1, the acoustic emission transducer 5 is typically mounted on a smooth surface wall inside the structure to be monitored. The transducer is preferably a sensitive crystal-type acoustic emission transducer, such as a commercially available Model No. S-140B acoustic transducer supplied by Dunegan/Endev Company, Rancho Viejo Road, San Juan Capistrano, California. The transducer 5 is clamped tighly on the smooth surface with a thin film of silicon lubricant between the sensitive surface of the transducer and the surface on which it is mounted. This provides a good acoustical coupling to the monitored surface.

The transducer 5 is typically mounted within 3 feet of the input to the signal processor and connected by means of a coaxial cable 7. The inner conductor of the cable is connected through a capacitor 9 to the gate electrode of a field effect input transistor 11. The gate electrode of transistor 11 is further connected to ground through a resistor 13. The source electrode is connected to ground through a biasing circuit 15 while the drain electrode of transistor 11 is connected to the positive voltage supply through a biasing resistor 17. The input amplifier stage further consists of a transistor 19 which has its base electrode connected to the drain electrode of transistor 11. The collector of transistor 19 is connected to ground through a resistor 21 and the emitter is connected to the positive voltage supply through a biasing circuit consisting of resistors 23 and 25 and a capacitor 27.

The input amplifier stage, or preamplifier stage, has a maximum gain of approximately 40 decibels selected by the appropriate resistance valves for resistors 23 and 25. For the maximum gain, resistor 23 is a 33 K ohm resistor and resistor 25 is a 6.8 K ohm resistor. However, in most applications a lower gain value is used in the range of 30 db wherein the resistor values for resistors 23 and 25 are 27 K ohms and 15 K ohms, respectively. The reason for the lower gain in the preamplifier stage for most applications is to minimize false alarms due to extraneous acoustical signals or power line transients.

Further gain control of the input signal is provided by a second amplifier stage which is designed around a special operational amplifier 29. The collector of transistor 19 is connected through a capacitor 31 and a series resistor 33 to the non-inverting input of amplifier 29. A resistor 35 is connected between the common connection points of capacitor 31 and resistor 33 and ground potential. Capacitor 31 and resistor 35 forms an RC filter circuit. This filter circuit operating in conjunction with the filtering provided by input capacitor 9 and resistor 13 is used to set the low-frequency cutoff point of the preamplifier stage. Typically, the low-frequency cutoff is fixed at about 800 Hz, slightly below the frequency range of the acoustical disturbance signals which are to be processed by the processor.

Returning now to the second amplifier stage, the amplifier 29 is preferably a commercially available RCA integrated circuit operational amplifier Model No. CA-3130. By connecting only the positive supply terminal of the amplifier to the positive voltage supply for the processor, this amplifier is designed to function also as a rectifier. By leaving the negative supply terminal input to the amplifier disconnected, the amplifier only passes positive signal levels supplied to the non-inverting input thereof.

To control the gain in the rectifying amplifier stage, the inverting input is connected to ground through a resistor 37 and a selectable resistance feedback loop is connected between the inverting input and the output of amplifier 29. The adjustable resistance feedback loop is provided with a plurality of resistors $R_1$–$R_N$ having one end commonly connected to the output of amplifier 29. The other end of the resistors is connected to respective switches $S_1$–$S_N$ to the inverting input of amplifier 29. The circuit is arranged so that normally only one of the switches is closed and thus only one resistance value is connected to the feedback loop for gain control. Typically, the maximum gain available is approximately 20 db. The purpose of the selectable gain control in the second stage is to make a final field adjustment of the overall gain to suit the acoustical characteristics of a particular installation.

Amplitude discrimination of the transducer signal, which has been properly amplified according to the desired sensitivity for the particular application, is provided by connecting the output of amplifier 29 to the input of a Schmitt trigger circuit 39. Typically, the threshold level of the Schmitt trigger is set at approximately 60% of the supply voltage which is normally 9.6 volts. The supply voltage may be provided by means of a 9.6 volt battery, such as a nickel/cadmium battery maintained at full charge by a small trickle-charger. The unit can operate in the stand-by condition for about three weeks from the battery alone.

The output of the Schmitt trigger 39 is connected to a digital-timing and pulse-shaping circuit for frequency discrimination of the transducer signal. This portion of the circuit consists of delay circuit 41, a one-shot 43 connected to the ouput of the delay circuit 41, a NAND gate 45 having one input connected to the output of one-shot 43 and a second one-shot 47 connected to the output of NAND gate 45. The output of the Schmitt trigger 39 is connected to the input of the delay circuit 41 and to the second input of the NAND gate 45. If the amplitude of the signal to the input of Schmitt trigger 39 exceeds 60% of the supply voltage twice within approximately 900 microseconds, an approximately 3-second pulse is applied from the output of one-shot 47 to the input of an alarm driver 49. The output of the alarm driver is connected to the alarm circuit 51.

The alarm 51 may take various forms. For example, the alarm may be a local buzzer which is sounded at the processor location, or a visual alarm which is activated locally, or various other alarm techniques, such as contacts opened by a relay which is energized by the alarm driver 49 opening the circuit of a supervised alarm circuit for an alarm at a remote location.

Figure 2:
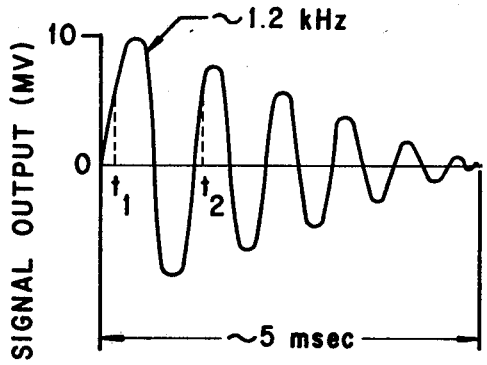
FIGS. 2 and 3 are graphic illustrations of typical output signals from the acoustic emission transducer for a disturbance in concrete or concrete/steel walls, such as a hammer blow on vault concrete and a hammer blow or metal saw stroke on vault steel, respectively.
Figure 3:
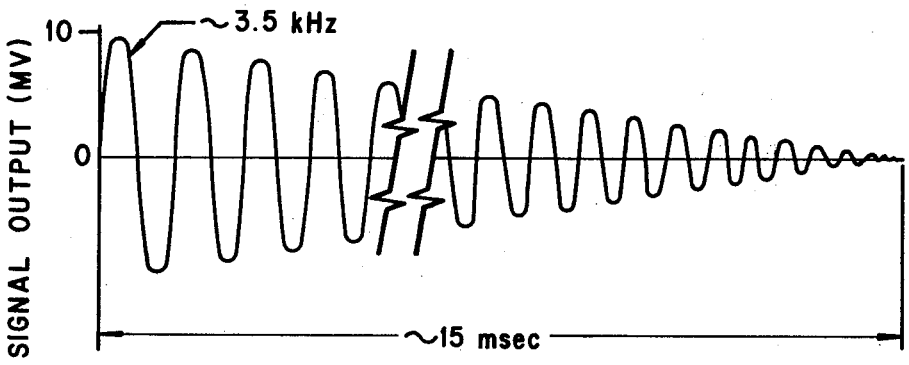

In operation a typical signal output from the transducer 5 due to a hammer-type blow on concrete or tile walls is a damped sinusoid of approximately 5 milliseconds duration at a frequency of between 1.1 and 1.3 K Hz. A typical signal of this type is shown in FIG. 2. The initial amplitude of the signal varies with the type of construction and distance from the disturbance to the detector, but it is typically 5–10 millivolts in amplitude. When the transducer is attached to the steel reinforced wall, the output signal due to a hammer blow or metal saw stroke is a similar output of approximately 15 milliseconds duration at about 3.5 K Hz. This type signal is shown in FIG. 3. When a signal such as that shown in FIG. 2 is applied to the input of the pre-amplifier stage at the gate of FET 11 and exceeds the lower cutoff frequency level, it is pre-amplified as pointed out above and applied to the non-inverting input of amplifier 29. With the proper gain selection in accordance with the desired sensitivity of the circuit and the corresponding threshold level of the Schmitt trigger 39, the trigger circuit 39 would be first triggered at time $t_1$ as shown in FIG. 2, this being the time the amplified and rectified signal first exceeds the threshold level of the Schmitt trigger 39. By the proper gain selection and the selection of the threshold level of the Schmitt trigger 39 the signal is discriminated on the basis of amplitude and thus low level signals from normal acoustical disturbances about the secured structure would not trigger a discriminating sequence. If the signal exceeds the threshold of the Schmitt trigger 39 a second time, time $t_2$, and the signal frequency is within the proper time frame, an alarm will be sounded in accordance with the following procedure.

The first trigger pulse at time $t_1$ is applied to the input of the delay circuit 41 which delays the signal 0.5 microsecond in order to prevent a false activation of the gate 45. The delayed signal is applied to the input of one-shot 43 which is triggered on the negative-going edge of the Schmitt trigger signal. The period of the Schmitt trigger output signal is the same as that of the acoustical disturbance. One-shot 43 is timed to generate a positive-going 900 microseconds pulse which is applied to the input of gate 45. If the time $t_2$–$t_1$ does not exceed 900 microseconds, the second pulse at time $t_2$ from the Schmitt trigger 39 applied to the input of gate 45 activates gate 45 causing the output to go low. This triggers one-shot 47 which generates a positive-going 3-second signal which is applied to the input of the alarm driver 49, thereby activating the alarm for approximately 3 seconds. Thus, the pulse-timing circuitry provides frequency discrimination in that the frequency of a signal having sufficient amplitude must be greater than about 1.1 K Hz in order that the alarm is triggered before the one-shot 43 times out.

This timing period has been found adequate for most anticipated disturbances which create signals as shown in the typical wave forms of FIGS. 2 and 3.

In a series of tests, the detection system was arranged upon walls of tile blocks, concrete blocks, and steel reinforced concrete with the transducer mounted directly on the wall. Weighted pellets were impacted on each of the walls at specific velocity for determining the minimum disturbance required for detection by the system. The minimize acoustical disturbances or impact momentums on each of these walls are listed in the Table below.

TABLE I

| Wall/Vault Construction | Momentum (kg. m/sec.) | Distance to Detector (m) |
|---|---|---|
| Tile Block | 0.3 | 4.0 |
| Concrete Block | 2.6 | 4.0 |
| Steel-Reinforced Concrete | 5.3 | 4.0 |

In tests of the system on a concrete vault wall of a secured structure, no nuisance alarms were generated over a six-month period. Thus, it will be seen that a very sensitive and responsive acoustic emission intrusion detector has been provided which is simple to construct, maintain and operate and may be used in monitoring secured structures with a minimum of alarms. Although the invention has been shown by way of a specific example, it will be obvious to those skilled in the art that various modifications and changes may be made in the described embodiment without departing from the spirit and scope of the invention as set forth in the following claims.

What is claimed is:

1. An acoustic emission intrusion detector for monitoring a secured structure and generating an alarm upon detection of acoustical signals generated durng forcible entry into said structure while minimizing false alarms based on signal amplitude and frequency discrimination, comprising:

an acoustic emission transducer mounted to sense vibrations generated in said structure and generating an a.c. signal at an output thereof in response to said vibrations;

a preamplifier circuit means responsive to the output of said transducer for providing preselected amplification of said a.c. signal;

signal amplitude discriminating means responsive to the output of said preamplifier for generating first and second successive timing pulses when the signal from said preamplifier exceeds a preselected amplitude threshold level, said first timing pulse being generated when the amplitude of a first cycle of said a.c. signal exceeds said threshold level and said second timing pulse being generated when the amplitude of a subsequent cycle of said a.c. signal exceeds said threshold level, thereby providing said amplitude discrimination; and a timing circuit means for monitoring the time span between said first and second timing pulses and generating an alarm signal when the time span is less than a preselected value, thereby providing said frequency discrimination, and means responsive to said alarm signal for providing an alarm indication.

2. The intrusion detector as set forth in claim 1 wherein said signal amplitude discriminating means includes an operational amplifier having an inverting input, a non-inverting input and an output, said non-inverting input of said operational amplifier being connected to the output of said preamplifier, a resistor connected between said inverting input and ground potential, a selectable resistance feedback network connected between the output and the inverting input of said operational amplifier for providing a selectable range of feedback resistance corresponding to a desired gain so that gain adjustmemt may be made for specific installations, and a Schmitt trigger circuit connected to the ouput of said operational amplifier and having a preselected threshold triggering level corresponding to said preselected amplitude threshold level for generating said timing pulses when the signal input thereto exceeds said threshold triggering level.

3. The intrusion detector as set forth in claim 2 wherein said timing circuit means includes a gate having a first input connected to the output of said Schmitt trigger circuit, a one-shot connected between the output of said Schmitt trigger circuit and a second input of said gate, said one-shot having a preselected period corresponding to a selected maximum time period between said first and second timing pulses so that only transducer signals having a period less than said preselected period activate said gate, and an alarm driver connected between the output of said gate and said alarm means.

4. The intrusion detector as set forth in claim 3 wherein said preamplifier circuit means includes a filter circuit means for providing a low frequency cutoff for transducer signals below about 800 Hz, thereby further minimizing false alarms.

* * * * *